United States Patent [19]

Pitel et al.

[11] 3,935,966

[45] Feb. 3, 1976

[54] GUN AND MINT DELIVERY UNIT FOR HELICAL FEED MERCHANDISING MACHINE

[75] Inventors: Irving Pitel, Edison; Richard S. Silverman, Springfield; Richard J. Mueller, Mountain Lakes, all of N.J.

[73] Assignee: Rowe International, Inc., Whippany, N.J.

[22] Filed: Mar. 22, 1974

[21] Appl. No.: 453,886

[52] U.S. Cl. ..... 221/75

[51] Int. Cl.[2] ..... G07F 11/36

[58] Field of Search ..... 221/75; 198/34 A, 213, 198/214

[56] References Cited

UNITED STATES PATENTS

| | | | |
|---|---|---|---|
| 3,335,907 | 8/1967 | Holstein et al. | 221/75 X |
| 3,601,281 | 8/1971 | Schlaf | 221/75 |
| 3,828,971 | 8/1974 | Offutt et al. | 221/75 |

*Primary Examiner*—Robert B. Reeves
*Assistant Examiner*—John P. Shannon
*Attorney, Agent, or Firm*—Shenier & O'Connor

[57] ABSTRACT

A gum and mint delivery unit for a merchandising machine of the helical feed type in which a product separator extends axially through a helix mounted for rotary unit between the unit walls extending from front to back of a shelf of the machine to permit packets of gum or mints or the like to be arranged vertically between the turns of the helix on opposite sides of the separator and in which a motor rotates the helix through one half of a revolution on each operation of the unit to cause a cam formed on the front of the helix to deliver an article over the front edge of the shelf so that articles are alternately delivered from one side of the separator and the other side thereof on successive operations of the unit.

8 Claims, 5 Drawing Figures

FIG 4
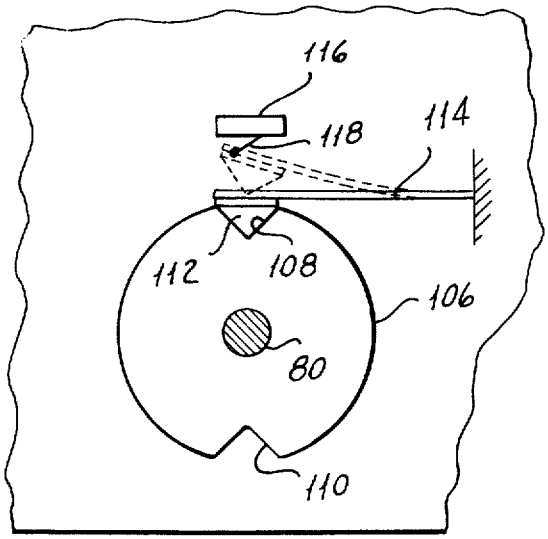
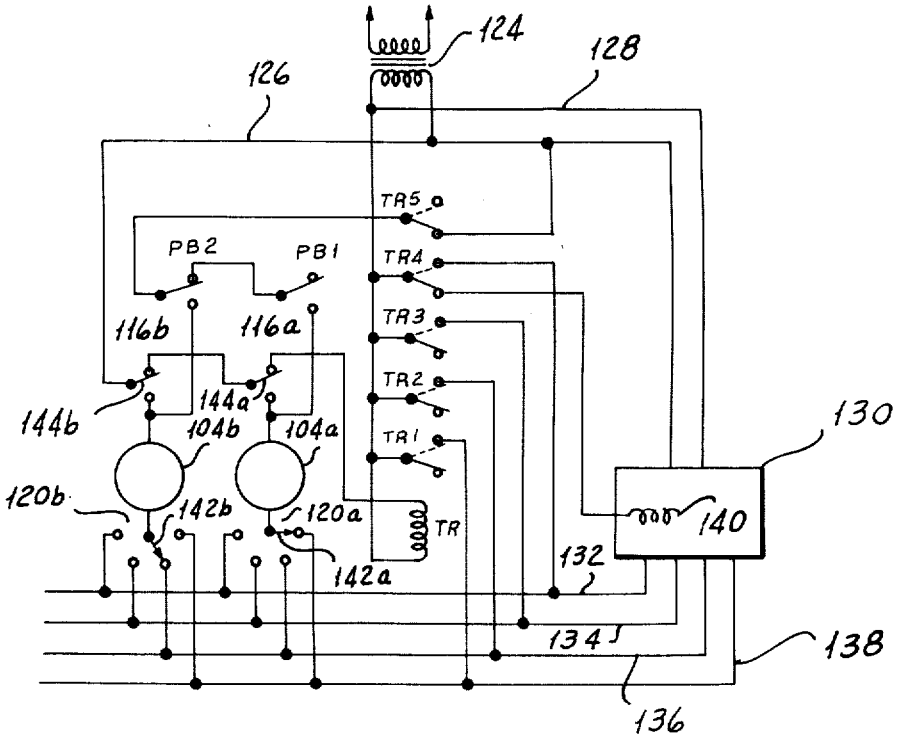
FIG 5

GUN AND MINT DELIVERY UNIT FOR HELICAL FEED MERCHANDISING MACHINE

BACKGROUND OF THE INVENTION

There are known in the prior art merchandising machines of the helical feed type adapted to deliver articles in response to rotary movement of one or more helices between the turns of which articles to be dispensed are disposed. Most machines of this type are intended to deliver merchandise in bags such, for example, as bags of chips and the like. It is desirable that such a machine also have the capability of delivering other articles such, for example, as packets of gum or mints or the like. Some attempts have been made in the prior art to adapt the bagged merchandise delivery units to dispense articles such as packets of gum and mints. Adaptation of such a unit to the delivery of articles of the latter type in the prior art involves a number of drawbacks. First, and most important, the amount of space occupied by the unit is excessively large for the capacity thereof. In addition, machines of the prior art generally involve relatively complicated mechanism for selectively operating the units of the machine.

We have invented a delivery unit for a helical feed merchandising machine which unit is especially adapted to deliver articles such as packets of gum or mints or the like. Our unit has a large capacity relative to the space occupied in the machine. It is certain in operation. It is simple in construction.

SUMMARY OF THE INVENTION

One object of our invention is to provide a gum and mint delivery unit for a merchandising machine of the helical feed type.

Another object of our invention is to provide a gum and mint delivery unit for a helical feed merchandising machine which unit has a large capacity for the space occupied thereby.

A further object of our invention is to provide a gum and mint delivery unit for a helical feed merchandising machine which unit is certain in operation.

Yet another object of our invention is to provide a gum and mint delivery unit for helical feed merchandising machine which unit is simple in construction.

Other and further objects of our invention will appear from the following description.

In general, our invention contemplates the provision of a gum and mint delivery unit for a merchandising machine of the helical feed type in which unit a product separator extends axially through a helix mounted for rotary movement between the unit walls which extend from front to back of a shelf of the machine and in which drive means rotates the helix through one half of a revolution on each operation of the unit to cause a cam formed at the front of the helix to deliver an article over the front edge of the shelf so that articles are dispensed alternately from one side of the separator and the other side thereof on successive operations of the unit.

BRIEF DESCRIPTION OF THE DRAWINGS

In the accompanying drawings which form part of the instant specification and which are to be read in conjunction therewith and in which like reference numerals are used to indicate like parts in the various views:

FIG. 3 is a fragmentary front elevation of a shelf of the machine shown in FIG. 1 illustrating two of our gum and mint delivery units with parts broken away and with other parts shown in section.

FIG. 4 is a fragmentary sectional view of the unit shown in FIG. 2 taken along the line 4—4 of FIG. 2.

DESCRIPTION OF THE PREFERRED EMBODIMENT

Figure 1:
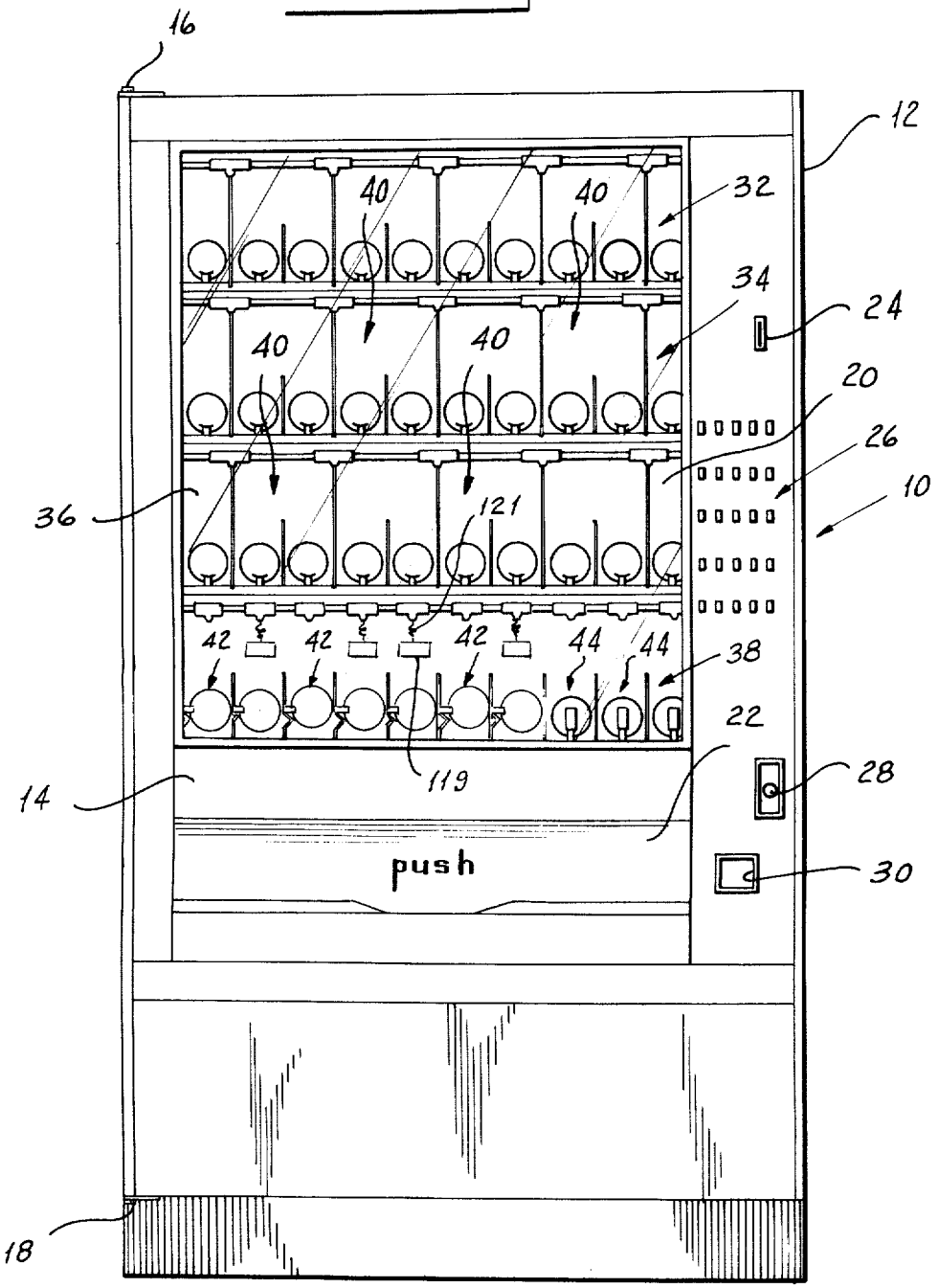
FIG. 1 is a front elevation of a merchandising machine of the helical feed type which is provided with our gum and mint delivery unit.
Figure 2:
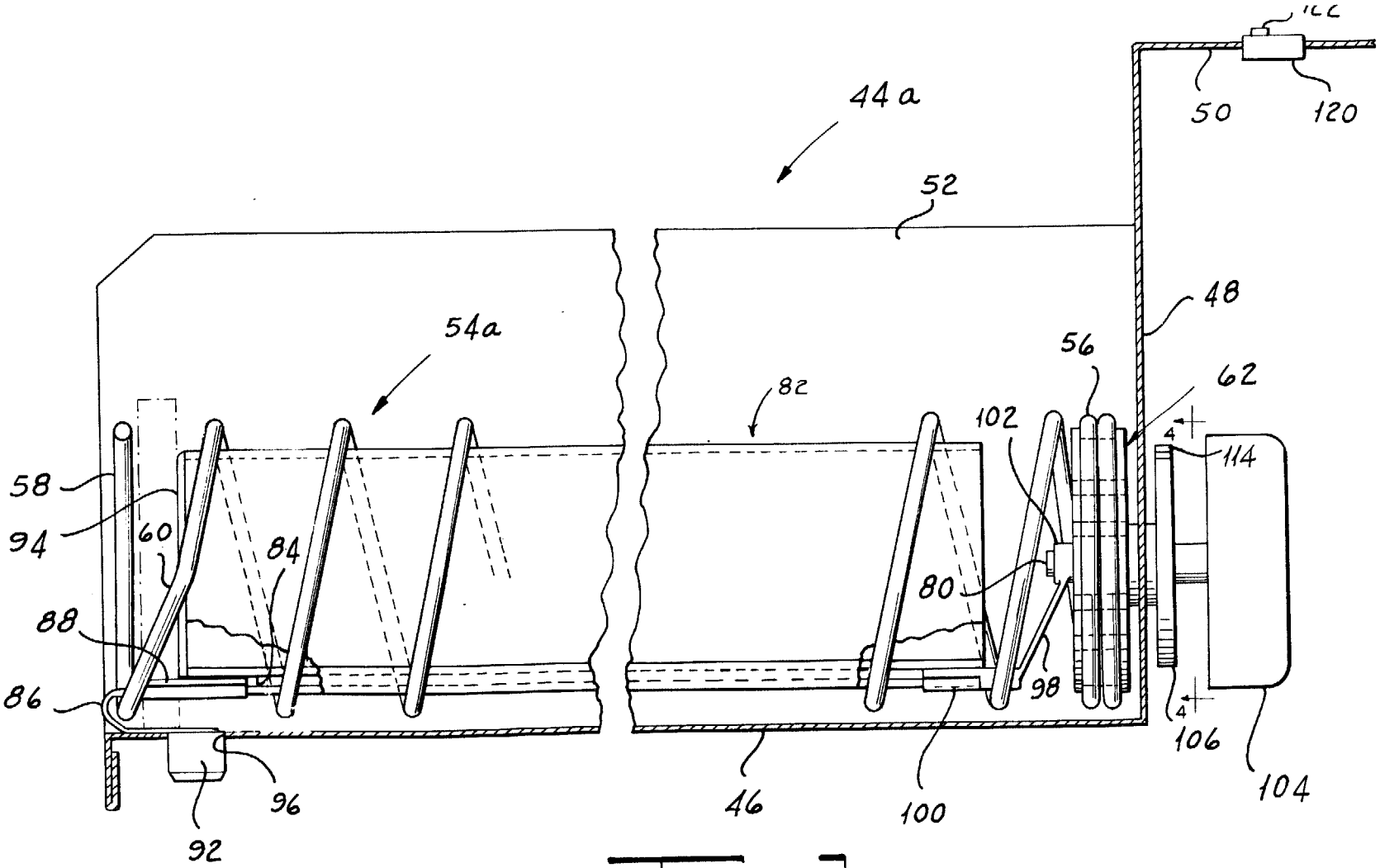
FIG. 2 is a sectional veiw through one shelf of the machine shown in FIG. 1 illustrating our gum and mint delivery unit.

Referring now to the drawings, a merchandising machine, indicated generally by the reference character 10, of the spiral feed type, includes a cabinet 12, having a door 14 supported on the cabinet by means of hinges 16 and 18. The machine 10 includes a window 20 in door 14 through which merchandise to be delivered can be viewed by the customer. We provide the main door 14 with a delivery door 22 adapted to be opened for access to merchandise delivered by one of the units to be described hereinbelow. A coin slot 24 in the door 14 permits coins to be introduced into the machine in anticipation of making a purchase. The buttons of an array 26 of push buttons are adapted to be operated to permit the customer to select a desired article of merchandise. As is conventional, we provide the door 14 with a lock 28 adapted to secure the door in closed position on the cabinet 12. A coin return recess 30 permits the customer to receive change or to have his coins returned to him in the event that he does not wish to complete a purchase.

The particular embodiment of the machine 10 illustrated in the drawings includes four respective merchandising levels indicated generally by the reference characters 32, 34, 36 and 38. In this embodiment each of the levels 32, 34 and 36 is made up of a plurality of main merchandise delivery units each of which is indicated generally respectively by the reference character 40. These units 40 are adapted to deliver articles of bagged merchandise, for example. The construction and operation of these units are described more fully in our copending application Ser. No. 454,118, filed Mar. 25, 1974, for "Helical Feed Merchandising Machine".

The lowest level 38 of the machine 10 includes a number of delivery units indicated generally by the reference character 42 which units are adapted to deliver articles of merchandise such, for example, as bars of candy. These units 42 are described in detail in our copending application Ser. No. 453,885, filed Mar. 25, 1974, for "Candy Bar Delivery Unit for Helical Feed Merchandising Machine". Also included in the level 38 are a number of our delivery units indicated generally by the reference character 44 which units 44 are adapted to deliver articles such, for example, as packets of gum or mints or the like.

The units 44 are supported on a shelf 46 of the level 38 of the merchandising machine. Shelf 46 is formed with a rear wall 48 carrying a rearwardly extending flange 50 along its upper edge. A plurality of partitions 52 secured to the shelf 46 by any suitable means divide the shelf into a number of compartments, each of which houses one of the units 42 or 44. Each unit includes a helix, indicated generally by the reference character 54, which is provided with a pair of closely spaced turns 56 at the rear thereof. We so form the first 180° at the front of the helix, identified by the reference character 58, as to have zero pitch. The next 90° of the helix, identified by the reference character 60, is formed with a greater pitch than the remainder of the helix so that the distance between the terminus of this 90° section and a corresponding point on the preceding turn is one-and-a-half times the distance between corresponding points on adjacent normal turns of the helix. As will more fully be pointed out hereinbelow, this arrangement provides a cam at the front of the helix for ensuring that the frontmost article is delivered over the edge of the shelf 46 in response to one half of a revolution of the helix 54.

A spider, indicated generally by the reference character 62 at the rear of each of the units 44, has a hub 64 from which a plurality of resilient arms 66, 68, 70 and 72, extend to connectors 74 and 76 which respectively connect pairs of arms 64 and 66 and 68 and 70. We provide the connectors with pairs of fingers 78 having grooves therein for receiving the turns 56 of the helix. A shaft 80, rotatably supported in the back 48, carries the spider 62 for rotation therewith. We form each helix 54 with a tail 81 adapted to be engaged by the bend connecting the arm 66 to the connector 74 of the spider 62 to ensure that the helix 54 turns with the spider and to prevent any slippage between the spider and the helix.

Each unit 44 includes an elongated product divider 82 having a rectangular cross sectional shape. We provide the base of each of the product dividers 82 with a re-entrant slot 84. A front divider supporting clip 86 is formed with an insert portion 88 adapted to be inserted into the slot 84 in the base of the product divider. Each of the clips 86 is provided with a pair of resilient legs 90 and 92 and with a cover portion 94 extending upwardly so as to cover the front of the product divider 82. After the insert 88 has been placed in the base slot 84, legs 90 and 92 are moved downwardly into an opening 96 in the shelf 46 and snapped in position therein securely to hold the front of the product divider 82 in position. It will be seen that the product divider 82 extends axially of the helix 54 and that the front turn of the helix is located between the base 46 and the portion of the clip 86 which is inserted into the product divider base slot. Thus, the front clip further serves to retain the helix in position in the unit.

Each of the units 44 includes a rear product divider support 98 formed with an insert portion 100 adapted to be received in the base slot 84 at the rear of the unit. The rear support 98 has a collar 102 adapted to be received by shaft 80.

We provide a respective motor and gearbox 104 for driving the shaft 80 of each of the units. Each of the motor and gearbox units 104 includes a cam 106 which we have illustrated as being carried by the portion of shaft 80 behind the back wall 48. Cam 106 is formed with a pair of detent recesses 108 and 110 which are located at diametrically opposite positions around the periphery of the cam 106. A detent 112 is carried by a spring arm 114 supported on the rear wall 48. Arm 114 normally urges the detent 112 into engagement with the cam 106. We select a relatively heavy spring material for the spring 114 so that the detent 112 exerts a positioning action on the helix 54 as it moves into one of the recesses 108 and 110. We also so arrange the detent and recesses that approximately 10° of revolution of the shaft 80 is required before spring 114 strikes the actuator 118 of a switch 116 adapted to complete the circuit of the motor 104 for the period of time during which the actuator is engaged by the spring arm. This prevents a dishonest person from momentarily closing a push button switch to be described hereinbelow to cause the unit to operate and, at the same time, receive his purchase price back.

We provide each of the units 44 with a price setting switch 120 adapted to be moved among four different positions to permit the merchandise to be sold at one of four prices as desired.

We provide each unit 42 and 44 with a flag 119 carrying selection and pricing information. Any suitable means such as a spring 121 or the like suspends the flag 119 in front of the unit. For purposes of simplicity not all of the flags are shown.

Figure 5:
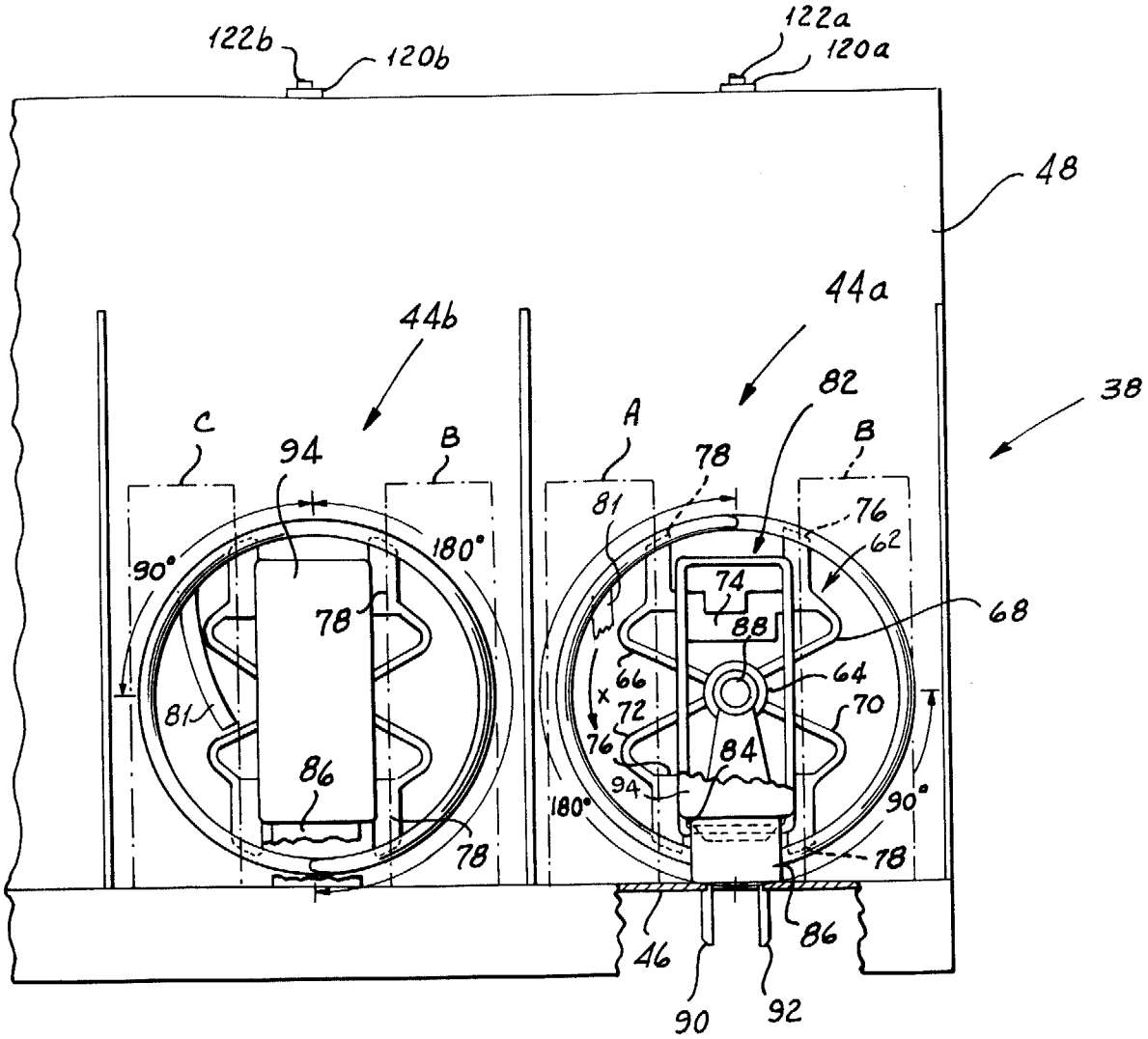
FIG. 5 is a schematic view of one form of electrical circuit which may be used to control our gum and mint delivery units.

Referring now to FIG. 5, one form of control circuit which may be employed in a merchandising machine including our units 44 includes a transformer 124 adapted to supply power to lines 126 and 128. We connect lines 126 and 128 to a coin mechanism 130 of any suitable type known to the art adapted to energize lines 132, 134, 136 and 138 in response to the deposit therein of sums of money corresponding to four respective prices, for example. The coin mechanism 130 includes a coin return electromagnet 140. Each of the price setting switches **120*a* and 120*b* includes an arm 142*a* or 142*b* adapted selectively to be moved into engagement with one of four contacts in response to the positioning of the element 122*a* or 122*b* of the switch. We connect the respective contacts of each of the switches 120*a* and 120*b* to the four price lines 132, 134, 136 and 138 leading out of the coin mechanism 130. The moveable contacts 142*a* and 142*b* of the switches 120*a* and 120*b* are respectively connected to one terminal of the motors 104*a* and 104*b*. The cycle switches 116*a* and 116*b* include respective moveable contacts 144*a* and 144*b* normally in engagement with upper contacts and adapted to be moved into engagement with lower contacts in response to the operation of the cam 100*a* and 100*b***. While we have shown a four price system it will be understood that we may provide as many prices as desired.

The control circuit includes a transfer relay TR which is normally energized to hold respective switches TR1 to TR5 in the positions shown. When winding TR drops out switches TR1 to TR5 move to alternate positions indicated in broken lines in FIG. 5. We connect the moveable contacts of switches TR1 to TR4 to the line 128. The moveable contact of switch TR5 is connected to the moveable contact of a push button switch PB2 of the array 26 associated with the unit **44*b*. This moveable contact of switch PB2 normally engages a contact connected to the moveable contact of a switch PB1 normally in engagement with the upper contact shown in FIG. 5. When either of the switches PB1 or PB2 is actuated, its moveable element engages a respective lower contact connected to the upper terminal of the motor 104*a* or 104*b*. We connect the normally engaged lower contact of switch TR4 to the coin return electromagnet 140 in the coin totalizer 130. The upper contacts of the respective switches TR1 to TR4 are connected to the price lines 138, 136, 134 and 132**.

As can readily be seen from the arrangement shown in FIG. 5, with power on winding TR normally is energized through the cycle switches 116*a* and 116*b*. When a sum in coins or bills or the like sufficient to permit a purchase to be made has been inserted in the coin mechanism 130, a selection may be made. At the same time, the price lines 132, 134, 136 and 138 are energized in accordance with the sum which has been deposited in the coin mechanism 130. Under these conditions, when the customer makes a selection he pushes one of the push buttons PB1 or PB2 to complete the circuit of the associated motor 104*a* or 104*b* which drives the corresponding cam 106 so that after a predetermined rotation of the cam the corresponding switch 116*a* or 116*b* is actuated to move its contact arm 144*a* or 144*b* out of engagement with the upper contact and into engagement with the lower contact. As soon as the moveable contact 144*a* or 144*b* leaves the upper contact, winding TR is deenergized to permit the switches TR1 to TR5 to move to the broken line positions. When this occurs, electromagnet 140 is deenergized and the credit is removed from the credit line. The motor continues to rotate until the detent drops into the next recess.

In operation of our gum and mint unit for a helical feed merchandising machine, when the motor and gearbox unit 104*a*, for example, is activated in the manner described above, the associated helix 54*a* rotates in the direction of the arrow X in FIG. 3. Assuming that the packet of merchandise to the left of the axis of the helix is furthest forward as the helix rotates through 180° it will be the first dispensed. For purposes of illustration we have illustrated this package in dot-dash lines and have identified it by the reference character A in FIG. 3. The package next furthest forward which is to the right of the helix as viewed in FIG. 3 has been indicated by the reference character B. As the helix travels through 180°, this packet B will be advanced to a position at which it will be the next dispensed upon the next operation of the unit in the course of which the helix rotates through 180°. As can be seen by reference to FIG. 3, initially the helix 44*a* is in a position at which its forward end is approximately at the top center of the unit. Following the first operation thereof, the end will be adjacent the bottom center of the unit. By way of example, we have illustrated this position of the helix 44*b*. Further we have designated the next package behind package A by the reference character C. That is to say, the position of the helix 54*a* in FIG. 3 illustrates the condition of a unit before its first operation, while the position of the helix 54*b* indicates the condition of a unit after its first operation. It will readily be appreciated that after the second operation of the helix, it will return to the condition shown for the helix 54*a* in FIG. 3.

It will be seen that we have accomplished the objects of our invention. We have provided a delivery unit for a helical feed merchandising machine which unit is especially adapted to deliver articles of merchandise such as packets of gum or packets of mints or the like. Our unit has a very large capacity for the space occupied thereby. It is certain in operation. It is simple in construction.

It will be understood that certain features and subcombinations are of utility and may be employed without reference to other features and subcombinations.

This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention what we claim is:

1. A delivery unit for feeding articles to the delivery area of a merchandising machine including in combination, a generally horizontally disposed shelf having a front edge, spaced side walls carried by said shelf, a helical delivery member formed with a plurality of turns, means rotatably mounting said delivery member between said side walls with said member extending from front to back of said shelf, an elongated article separator extending axially of said delivery member, said delivery member having a front terminus and a zero pitch portion for a predetermined angular extent from said terminus and a greater pitch portion disposed between said zero pitch portion and the remainder of said helical delivery member, said greater pitch portion forming a cam for delivering the leading article over the front edge of the shelf, and means for rotating said helical delivery member to deliver the leading article over the front edge of said shelf.

2. A delivery unit as in claim 1 in which said rotating means comprises means for limiting the rotation of said delivery member to one half revolution on each operation of said machine.

3. A delivery unit as in claim 1 in which said delivery member rotating means rotates said member through approximately 180° on successive operations of said machine, said member having a first inactive position with said terminus adjacent to the top of said unit and a second inactive position with said terminus adjacent to the bottom of said unit, said member occupying said inactive positions respectively following successive operations of said machine.

4. A delivery unit as in claim 3 in which said zero pitch portion extends for approximately 180° from said terminus and in which said greater pitch portion extends from said zero pitch portion for approximately 90° to the remainder of said helical member.

5. A delivery unit as in claim 1 in which said zero pitch portion extends through approximately 180° and in which said greater pitch portion extends through approximately 90°.

6. A delivery unit as in claim 5 in which said greater pitch portion has twice said normal pitch.

7. A delivery unit as in claim 6 in which said terminus is adjacent to one of the top and bottom of said unit in the inactive condition of said member.

8. A delivery unit as in claim 1 in which said article separator has an elongated cross-sectional shape in a plane perpendicular to the axis of said delivery member, said unit including means mounting said article separator within said helical delivery member with the longer cross-sectional dimension of the separator extending vertically to define article receiving spaces between said separator and said side walls and between adjacent turns of said helical delivery member for receiving small elongated articles on end.

* * * * *

UNITED STATES PATENT OFFICE

CERTIFICATE OF CORRECTION

Patent No. 3,935,966 Dated February 3, 1976

Inventor(s) Irving Pitel, Richard S. Silverman and Richard J. Mueller

It is certified that error appears in the above-identified patent and that said Letters Patent are hereby corrected as shown below:

Title Page and Column 1, lines 1 and 2, the title of the invention should read:

"GUM AND MINT DELIVERY UNIT FOR HELICAL FEED MERCHANDISING MACHINE"

Signed and Sealed this twentieth Day of April 1976

[SEAL]

*Attest:*

RUTH C. MASON
*Attesting Officer*

C. MARSHALL DANN
*Commissioner of Patents and Trademarks*